US007741767B2

(12) United States Patent
Yokota et al.

(10) Patent No.: US 7,741,767 B2
(45) Date of Patent: Jun. 22, 2010

(54) IMAGE DISPLAY APPARATUS HAVING FIRST AND SECOND REGIONS WITH RESPECTIVE LUMINANCES

(75) Inventors: Masahiro Yokota, Fukaya (JP); Tsuyoshi Oyaizu, Hiratsuka (JP); Hiroaki Ibuki, Fujisawa (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 237 days.

(21) Appl. No.: 11/935,898

(22) Filed: Nov. 6, 2007

(65) Prior Publication Data

US 2008/0111467 A1 May 15, 2008

(30) Foreign Application Priority Data

Nov. 15, 2006 (JP) ..... 2006-309175

(51) Int. Cl.
*H01J 1/62* (2006.01)
*H01J 1/304* (2006.01)

(52) U.S. Cl. ..... 313/496; 313/495

(58) Field of Classification Search ..... 313/495–497
See application file for complete search history.

(56) References Cited

U.S. PATENT DOCUMENTS 5,939,823 A * 8/1999 Kiyomiya et al. ..... 313/495
6,426,596 B1 7/2002 Yamamoto et al. ..... 315/169.1
6,653,777 B1 * 11/2003 Onishi ..... 313/495
6,677,706 B1 1/2004 Hara et al. ..... 313/496
7,002,289 B1 * 2/2006 Porter et al. ..... 313/496
2004/0174114 A1 * 9/2004 Ohishi et al. ..... 313/495
2005/0280349 A1 * 12/2005 Nishikawa et al. ..... 313/496

FOREIGN PATENT DOCUMENTS

| | | |
|---|---|---|
| EP | 1 786 018 | 5/2007 |
| JP | 10-326583 | 12/1998 |
| JP | 2000-311642 | 11/2000 |
| JP | 2006-73248 | 3/2006 |

* cited by examiner

*Primary Examiner*—Karabi Guharay
(74) *Attorney, Agent, or Firm*—Fitzpatrick, Cella, Harper & Scinto

(57) ABSTRACT

An image display apparatus including a rear plate and a face plate facing the rear plate; wherein the rear plate includes an electron-emitting device; and the face plate includes a light-emitting body for emitting light through irradiation of electrons from the electron-emitting device, and a metal back arranged between the electron-emitting device and the light-emitting body. The light-emitting body includes a first region in which a luminance with respect to a maximum value of a luminance in the light-emitting body is greater than or equal to 50% and a second region in which the luminance is less than 50%; and an arithmetic mean deviation of the profile (Ra) of the metal back in the second region is larger than the arithmetic mean deviation of the profile (Ra) of the metal back in the first region.

9 Claims, 8 Drawing Sheets

IMAGE DISPLAY APPARATUS HAVING FIRST AND SECOND REGIONS WITH RESPECTIVE LUMINANCES

BACKGROUND OF THE INVENTION

1. Field of the Invention

The present invention relates to an image display apparatus, in particular, to a configuration of a metal back arranged on a face plate.

2. Description of the Related Art

Field Emission Display (FED) and Surface-conduction Electron-emitter Display (SED) are known as flat display apparatuses based on a light emission principle similar to the cathode ray tube. In such flat display apparatuses, electron beam having high energy is irradiated to phosphors and the phosphors emit light, whereby a desired image is obtained.

A general phosphor screen configuration used in such flat display apparatus is shown in FIG. 6. A light shielding layer 21 and a bank layer 22 are arranged on a face plate 120. A light-emitting body 24 that emits one of the three colors of red, green, or blue is formed in an opening 23 of the light shielding layer 21. The light-emitting bodies 24 are covered by a metal back 125. As shown in FIG. 7, when irradiating the electron beam to each light-emitting body 24R, 24G, 24B of red, green, and blue, the electron beam 27 is irradiated to a central region of each light-emitting body 24R, 24G, 24B and the irradiation amount to the peripheral region is small.

The light shielding layer 21 is made of black substance that lowers reflectance by absorbing outside light, thereby preventing reflection of outside light and enhancing blackness of the screen. The bank layer 22 is a wall that divides each light-emitting body 24 so that the light-emitting body 24 is accommodated at a predetermined position, and normally has a film thickness of about the same extent as the light-emitting body 24. The bank layer 22 is not an essential configuration, and is not used in some configurations.

Normally, the opening 23 is orderly arrayed in dot form vertically and horizontally, and forms a filling section of each light-emitting body 24. The light-emitting body 24 is made of phosphor particles 31 filled so as to cover the opening 23, and performs the desired light emission through irradiation of electron beam. The metal back 125 reflects the light emitted towards the rear plate side from the phosphor particles 31 towards the front side of the display apparatus, thereby enhancing the light emission intensity.

FIG. 8 shows a cross section of a conventional face plate.

SUMMARY OF THE INVENTION

As described above, the light-emitting body 24 includes a region (central region) at where the electron irradiation amount is large and a region (peripheral region) at where the irradiation amount is small. Image display is mainly performed by light emission at the central region, but outside light simultaneously enters the light-emitting body 24 and the metal back 125 from outside the display apparatus, and is reflected from the metal back 125 towards the outside of the display apparatus. Such reflection of outside light is the cause of degradation of blackness.

It is an object of the present invention to provide an image display apparatus capable of preventing degradation of blackness caused by reflection of outside light while suppressing influence on the luminance.

An image display apparatus of the present invention includes a rear plate and a face plate facing the rear plate. The rear plate includes an electron-emitting device; and the face plate includes a light-emitting body for emitting light through irradiation of electrons from the electron-emitting device and a metal back arranged between the electron-emitting device and the light-emitting body, the light-emitting body including a first region in which a luminance with respect to a maximum value of a luminance in the light-emitting body is greater than or equal to 50% and a second region in which the luminance is less than 50%. An arithmetic mean deviation of the profile of the metal back in the second region is larger than the arithmetic mean deviation of the profile of the metal back in the first region.

Another image display apparatus of the present invention includes a rear plate and a face plate facing the rear plate. The rear plate includes an electron-emitting device; and the face plate includes a light-emitting body for emitting light through irradiation of electrons from the electron-emitting device, and a metal back arranged between the electron-emitting device and the light-emitting body, the light-emitting body including a first region in which a luminance with respect to a maximum value of a luminance in the light-emitting body is greater than or equal to 50% and a second region in which the luminance is less than 50%. A ratio of an area of the metal back covering the second region with respect to an area of the second region is smaller than a ratio of an area of the metal back covering the first region with respect to an area of the first region.

Another further image display apparatus of the present invention includes a rear plate and a face plate facing the rear plate. The rear plate includes an electron-emitting device; and the face plate includes a light-emitting body for emitting light through irradiation of electrons from the electron-emitting device, and a metal back arranged between the electron-emitting device and the light-emitting body, the light-emitting body including a first region in which a luminance with respect to a maximum value of a luminance in the light-emitting body is greater than or equal to 50% and a second region in which the luminance is less than 50%. The metal back covers at least the first region, and a diffuse reflectance in the second region is smaller than a diffuse reflectance in the first region.

"Arithmetic mean deviation of the profile" (Ra) in the present invention is defined by JIS B 0601 (1994).

"Diffuse reflectance" in the present invention indicates the ratio of diffused light with respect to the incident light on the plane. Specifically, the diffuse reflectance refers to the ratio measured at an incidence angle of 45 degrees and a light receiving angle of 0 degree with respect to the normal line of the plane.

According to the present invention, the image display apparatus capable of preventing degradation of blackness caused by reflection of outside light while suppressing influence on the luminance is provided.

DESCRIPTION OF THE PREFERRED EMBODIMENTS

The embodiments of the present invention will now be described. The image display apparatus of the present invention is suitably applied to FED and SED.

First Embodiment

Figure 1:
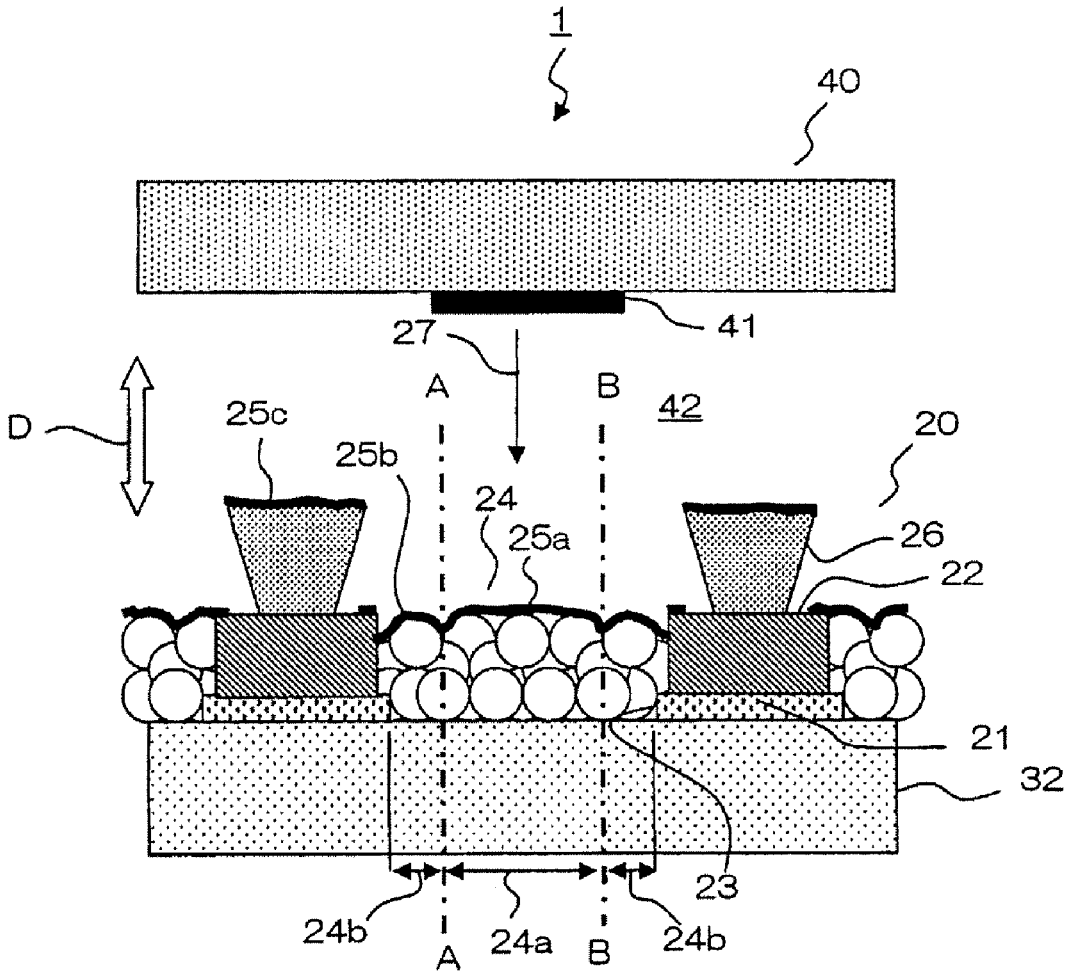
FIG. 1 is a schematic cross sectional view of a face plate showing a first embodiment of the present invention.

FIG. 1 is a schematic cross sectional view of a phosphor screen configuration used in the first embodiment of the present invention. A flat display apparatus 1 includes a rear plate 40 and a face plate 20, where the rear plate 40 and the face plate 20 are adhered facing each other through an appropriate method by way of a sidewall (not shown), and has an inside (gap 42) maintained in vacuum. The rear plate 40 includes a great number of electron-emitting devices 41 facing the gap 42.

Figure 7:
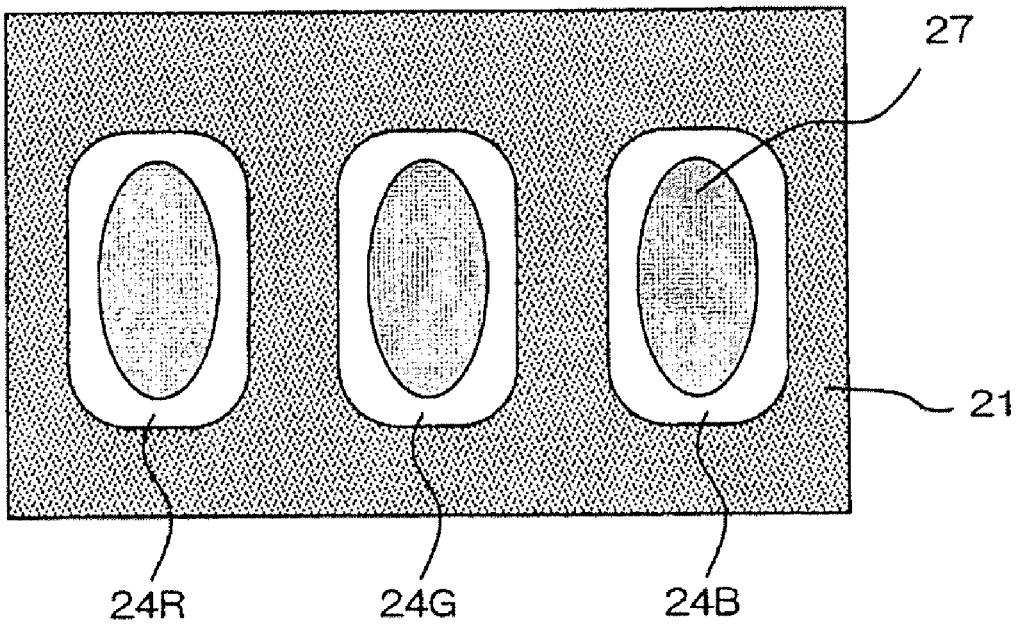
FIG. 7 is a frame format view showing a state in which electron beam is irradiated on a light-emitting body.

The face plate 20 includes a great number of light-emitting bodies 24 and a metal back 25. The light-emitting bodies 24 are arranged facing the gap 42 and emit light by irradiation of electrons from the corresponding electron-emitting device 41. The metal back 25 is arranged between the electron-emitting devices 41 and the light-emitting bodies 24. The light-emitting bodies 24 are formed on a glass substrate 32, and have the upper side covered by one part of the metal back 25. The face plate 20 includes a light shielding layer 21 (light shielding member) for partitioning the adjacent light-emitting bodies 24, and a bank layer 22 is formed on the light shielding layer 21. The light-emitting bodies 24 are formed at an opening 23 of the light shielding layer 21. The light-emitting bodies 24 are respectively assigned for light emission of one of red, green, and blue, as shown in FIG. 7, but only one light-emitting body is shown.

The light-emitting body 24 includes a central region 24a at where the irradiation amount of the electron per unit area is relatively large, and a peripheral region 24b at where the irradiation amount of the electron is relatively small. As shown in FIG. 7, the irradiation range (central region 24*a*) of the electron beam 27 irradiated to the light-emitting body 24 is smaller than the area of the light-emitting body 24. The peripheral region 24*b* of the light-emitting body 24 has an extremely small electron beam density, and thus its contribution to light emission is small. The chain lines A-A, B-B in FIG. 1 show the boundary parts of the central region 24*a* and the peripheral region 24*b*. Herein, the boundary of the central region 24*a* and the peripheral region 24*b* is defined as a line at which the electron beam density to be irradiated becomes a half-value of the maximum value. That is, the central region 24*a* or "first region" in the present invention is a region in which the luminance with respect to the maximum value of the luminance in the light-emitting body 24 is greater than or equal to 50%. Furthermore, the peripheral region 24*b* or "second region" in the present invention is a region in which the luminance with respect to the maximum value of the luminance in the light-emitting body 24 is less than 50%. In other words, "first region" and "second region" in the present invention are regions defined by the ratio of the luminance with respect to the maximum value of the luminance in the light-emitting body, and are not defined by positions such as center or periphery of the light-emitting body 24.

The metal back 25 includes a first portion 25*a*, a second portion 25*b*, and a third portion 25*c* depending on the formed location. The first portion 25*a* is the portion that covers the central region 24*a* when the face plate 20 is viewed from the rear plate 40 in a direction orthogonal to the face plate 20 (hereinafter referred to as plate orthogonal direction D). The second portion 25*b* is the portion that covers the peripheral region 24*b* when the face plate 20 is viewed from the rear plate 40 in the plate orthogonal direction D. The third portion 25*c* is the portion that covers the light shielding layer 21 when the face plate 20 is viewed from the rear plate 40 in the plate orthogonal direction D.

Figure 8:
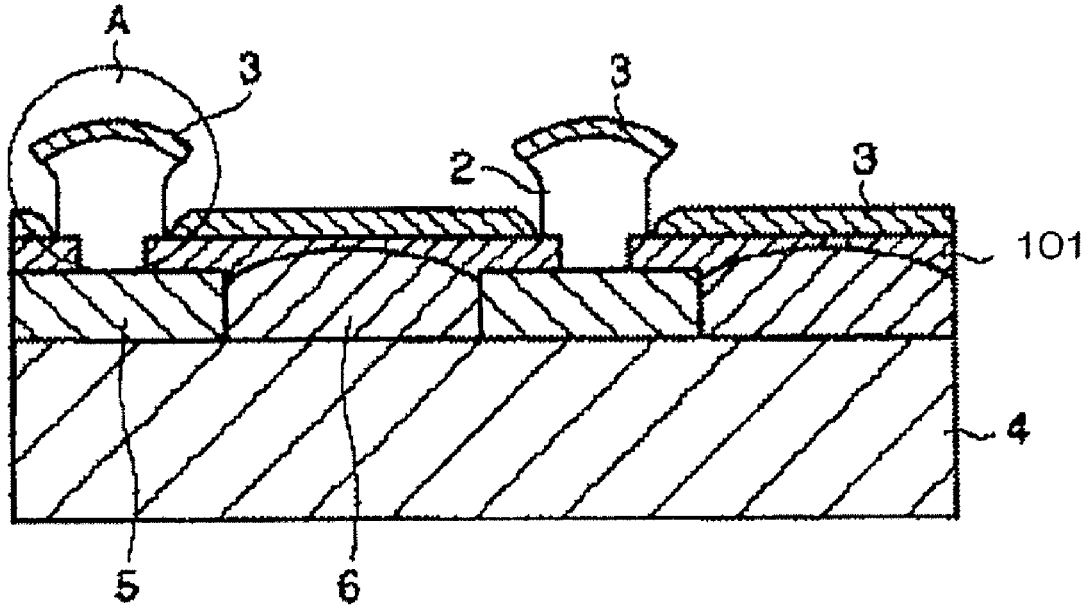
PRIOR ART Fig. 8
FIG. 8 is a schematic cross sectional view of a face plate in a conventional flat display apparatus adopting a metal back separation configuration.

The withstand voltage property, which is a problem unique to the flat display apparatus such as FED and SED, will now be described. The gap between the face plate and the rear plate configuring the display apparatus is in a few millimeters order, and discharge is likely to occur compared to the cathode ray tube since high voltage is applied to the gap. Thus, a discharge resistance technique of separating the metal back (getter layer) for each light-emitting body as shown in FIG. 8 has been disclosed. A getter separation layer 2 is arranged on a black matrix layer 5, and the getter layer that covers a phosphor layer 6 and the getter layer that covers the black matrix layer 5 are arranged in a separated manner. Thus, even if discharge occurs in a certain light-emitting body 24, the influence of discharge will be localized since the metal back (getter layer) to which the discharge current is to be transmitted is separated.

Such discharge resistance technique is used in the present embodiment, where a metal back separation layer 26 is formed on the light shielding layer 21, and the third portion 25*c* is formed on the metal back separation layer 26. That is, the third portion 25*c* is arranged at a position closer to the electron-emitting device 41 than the first portion 25*a* and the second portion 25*b*, and thus is physically separated, and as a result, electrically separated from the first portion 25*a* and the second portion 25*b*. The metal back 25 is desirably electrically separated from the adjacent metal back 25 along at least one side of the light-emitting body 24.

Figure 2A:
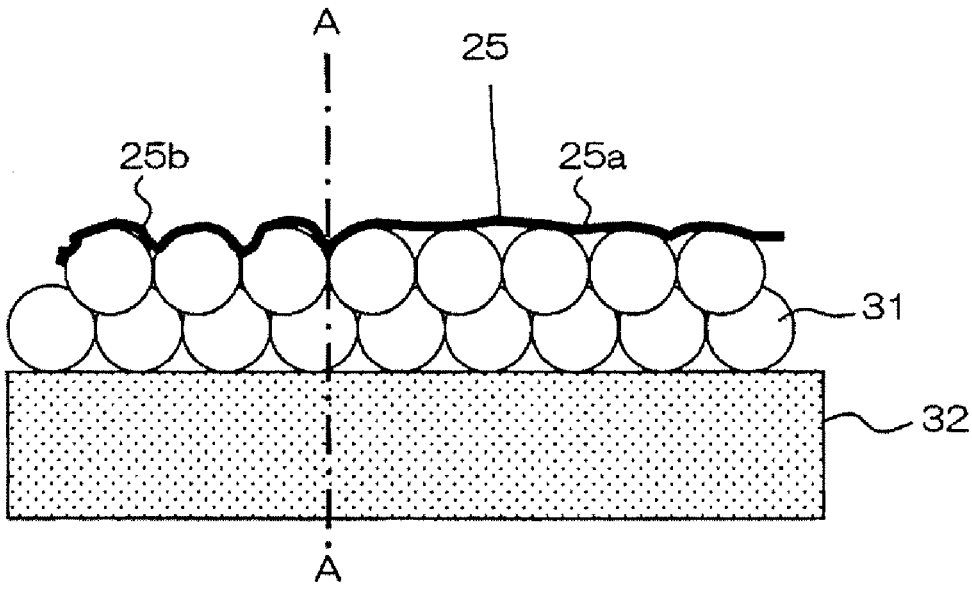
FIG. 2A is a partial enlarged sectional view of the face plate shown in FIG. 1.

FIG. 2A is a partial enlarged view of the metal back near the boundary part. An arithmetic mean deviation of the profile (Ra) of the metal back of the second portion 25*b* is larger than the arithmetic mean deviation of the profile (Ra) of the metal back of the first portion 25*a*. Specifically, the metal back 25 is closely attached to the phosphor particles 31 following the shape of the phosphor particles 31 at the peripheral region 24*b*, and thus the degree of concavity and convexity is large. Such concavity and convexity of the metal back can be checked with, for example, SEM cross section. The concavity and convexity can also be checked by measuring the height of the metal back surface.

The diffuse reflectance of the second portion 25*b* of the metal back 25 is smaller than the diffuse reflectance of the first portion 25*a*. "Diffuse reflectance" herein indicates the ratio of diffused light with respect to the incident light on the plane, as described above. Specifically, the diffuse reflectance refers to the ratio measured at an incidence angle of 45 degrees and a light receiving angle of 0 degree with respect to the normal line of the plane. The diffuse reflectance represents the brightness of the color of the screen, and thus low diffuse reflectance in the image display apparatus will mean enhanced blackness of the screen.

According to such configuration, the second portion 25*b* scatters the outside light entered from outside the flat display apparatus 1 and reflects the light from the face plate 20 towards the outside of the flat display apparatus 1, and thus the diffuse reflectance lowers and the blackness of the screen improves compared to the prior art. The present embodiment suppresses adverse effect by the reflection of outside light at the peripheral region 24*b* of the light-emitting body 24 that contributes little to light emission by increasing the degree of concavity and convexity of the metal back. Therefore, the present embodiment is effective when the size of the irradiated electron beam is small with respect to the size of the light-emitting body 24.

In the present embodiment, as a result of increase in contacting area per unit area between the metal back 25 and the phosphor particles 31 at the peripheral region 24*b*, the adhesion of the metal back 25 to the phosphor particles 31 enhances at the peripheral region 24*b*. Consequently, the present embodiment also has an advantage that the metal back 25 is less likely to be stripped and that withstand voltage property can be enhanced. That is, since large electric field that accelerates the electron beam is applied to the small gap 42 between the face plate and the rear plate in FED and SED, discharge often occurs between the plates. In particular, the metal back formed on the phosphors is often stripped by Coulomb force and causes discharge. This problem is particularly significant in the metal back separation configuration in which attachment force of the metal back 25 can only be obtained from the portion contacting the phosphor particles 31. Furthermore, since the metal back 25 is formed substantially flat at the vertex of the phosphor particles 31 having large particle diameter, the contacting surface with the phosphor particle 31 is small and the metal back 25 tends to be easily stripped. If the contacting region of the metal back 25 and the phosphor particle 31 is increased at the central region 24*a* in order to overcome such problem, the surface of the metal back 25 inevitably becomes a concave-convex shape following the phosphor particles 31, whereby the back light from the phosphor particles 31 to be originally reflected towards the front scatters and the luminance lowers. In the present embodiment, the adhesion of the metal back 25 and the phosphor particles 31 is enhanced at the peripheral region 24*b* while maintaining the shape of the central region 24*a* flat, and thus the metal back 25 is less likely to be stripped while suppressing influence on the luminance and the withstand voltage property can be enhanced.

Figure 2B:
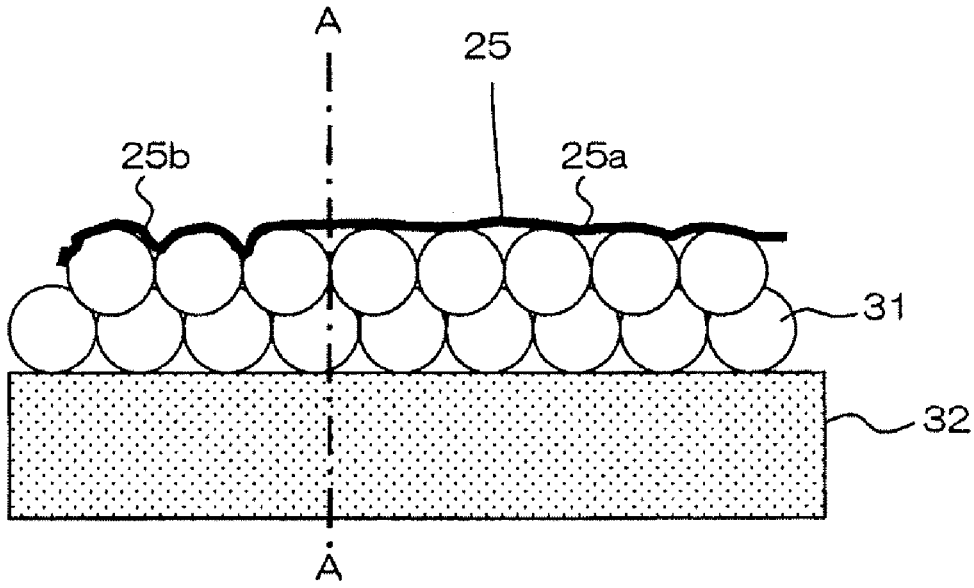
FIG. 2B is another example of a partial enlarged view of the face plate shown in FIG. 1.

In FIG. 2A referenced in the above description, the chain line A-A, which is the boundary part of the central region 24*a* and the peripheral region 24*b*, is at a position equal to the boundary of the first portion 25*a* and the second portion 25*b* of the metal back, but the present invention is not limited to such configuration. That is, the advantage of the present invention is still obtained even if the chain line A-A is at the position different from the boundary of the first portion 25*a* and the second portion 25*b* of the metal back. FIG. 2B shows a configuration in which the first portion 25*a* of the metal back covers not only the central region 24*a* but also one part of the peripheral region 24*b*. That is, the metal back in the present invention is not limited to the configuration of covering only the "first region", but is a configuration covering "at least the first region".

In this case, the diffuse reflectance and the arithmetic mean deviation of the profile (Ra) in the first portion 25*a* of the metal back at the peripheral region 24*b* are no different from the diffuse reflectance and the arithmetic mean deviation of the profile (Ra) in the first portion 25*a* of the metal back at the central region 24*a*. However, "diffuse reflectance in the second region" and "arithmetic mean deviation of the profile of the metal back in the second region" do not refer to such local regions and refer to the diffuse reflectance and the arithmetic mean deviation of the profile (Ra) averaged per unit area. In FIG. 2B, the metal back covering the central region 24*a* is only the first portion 25*a*, whereas the metal back covering the peripheral region 24*b* is the first portion 25*a* and the second portion 25*b*. Thus, the diffuse reflectance and the arithmetic mean deviation of the profile (Ra) averaged per unit area are different between the central region 24*a* and the peripheral region 24*b*, and the property of the diffuse reflectance and the arithmetic mean deviation of the profile (Ra) show the same property as for the case explained with reference to FIG. 2A. This is the same for the embodiment to be hereinafter described.

A configuration of separating the metal back by the metal back separation layer 26 has been described in the present embodiment, but is not an essential requirement of the present invention.

Figure 3:
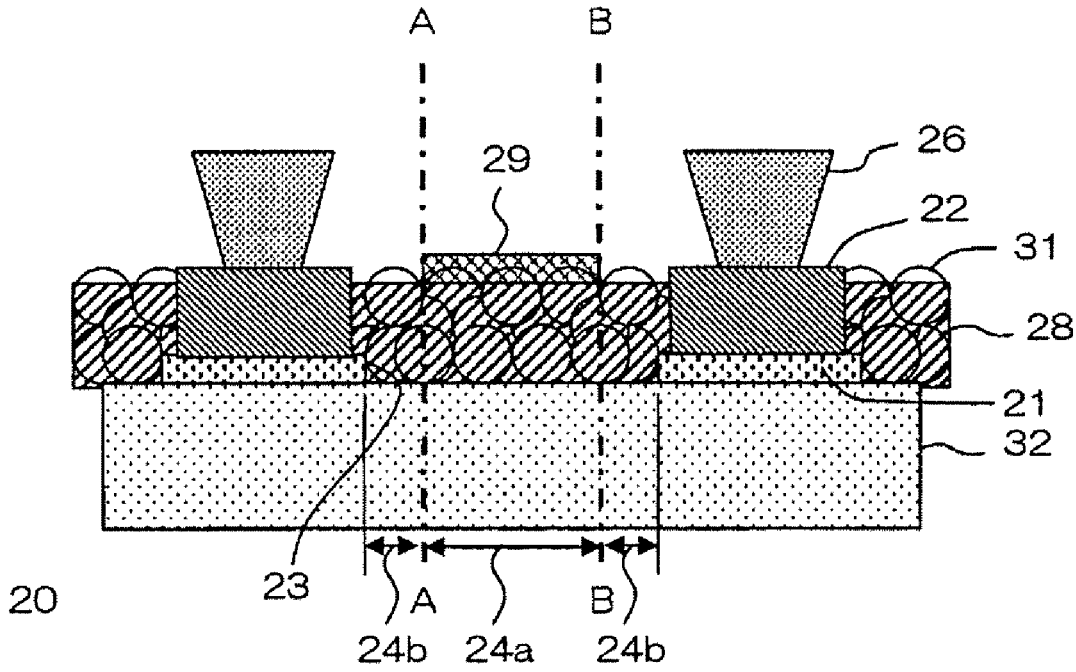
FIG. 3 is a frame format view describing a method of manufacturing the face plate shown in FIG. 1.

FIG. 3 is a frame format view describing a method of manufacturing the above-described metal back. The light shielding layer 21 and the bank layer 22 are formed on the glass substrate 32 by photolithography, and the opening 23 is formed in the light shielding layer 21. The phosphor particles 31 of red, green, or blue is filled in each opening 23 to form the light-emitting body 24. The metal back separation layer 26 is formed on one part of the bank layer 22 by photolithography. In one example, the upper surfaces of the light-emitting body 24 and the bank layer 22 are above the glass substrate 32 by about 10 μm, and the bank layer 22 also has a thickness of about 10 μm. The metal back separation layer 26 is formed only at the left and right ends of the light-emitting body 24, but is not limited thereto. The left and right width of the light-emitting body 24 is 150 μm, and the half-value width (central region) of the electron beam to be irradiated is 120 μm, and 15 μm of each left and right end of the light-emitting body is the peripheral region.

First and second planarizing layers 28, 29 are formed on the light-emitting body 24 by photolithography. The metal back 25 can also be formed by depositing metal, but since the phosphor particles 31 are rough particles of about 2 to 8 μm, gap becomes large if the phosphor particles are simply deposited, and the metal back 25 will not be grown. Thus, two planarizing layers 28, 29 are formed to fill the gap between the phosphor particles 31. Specifically, the first planarizing layer 28 is formed such that part of the vertex of the upper most phosphor particles 31 of the filled phosphor particles 31 is exposed. The second planarizing layer 29 is formed on the first planarizing layer 28 of the central region 24*a* to completely fill the concavity and convexity of the phosphor particles 31, thereby obtaining a planar surface. The metal layer is deposited in this state, and thereafter, the first planarizing layer 28 and the second planarizing layer 29 are removed, so that the metal back 25 of concave-convex shape closely attached to the phosphor particles 31 is formed at the peripheral region 24*b*, as shown in FIG. 2.

Second Embodiment

Figure 4:
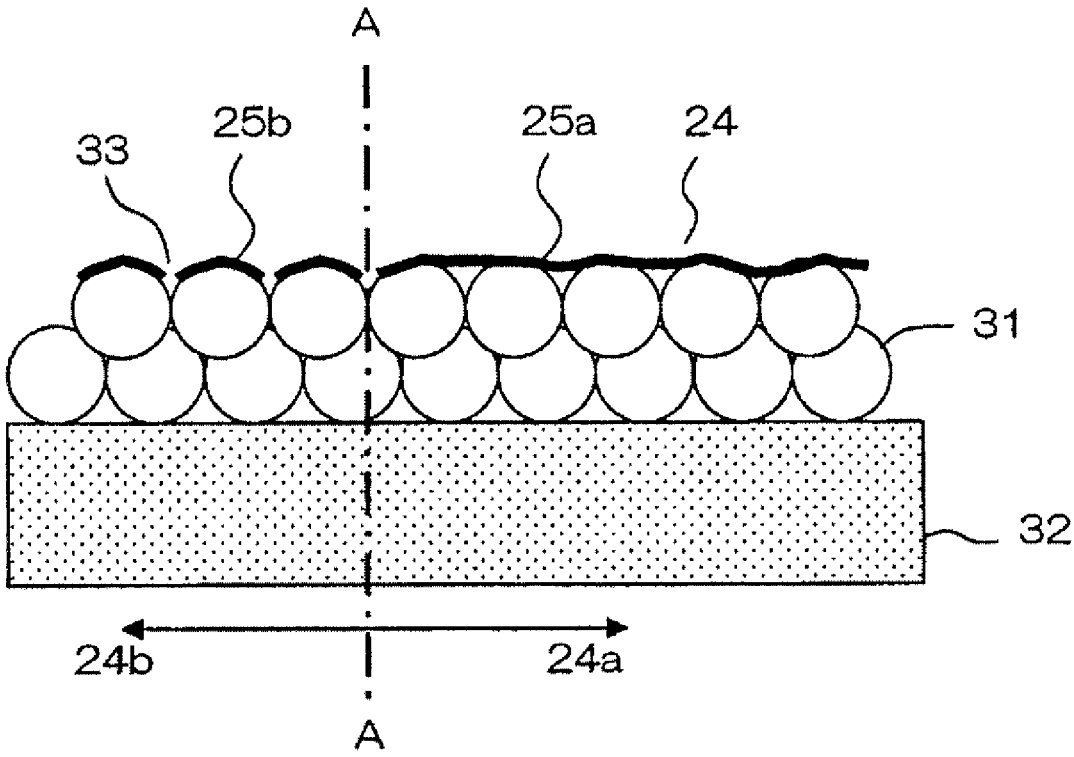
FIG. 4 is a schematic cross sectional view of a face plate showing a second embodiment of the present invention.

FIG. 4 is a schematic cross sectional view of a face plate showing the second embodiment of the present invention. The present embodiment has features in that the second portion 25*b* of the metal back includes a pinhole 33 for exposing one part of the phosphor particles 31 configuring the light-emitting body 24. The pinhole 33 may be formed for every phosphor particle 31 as shown in the figure, or may be formed for every plurality of phosphor particles 31. The pinhole 33 may also be formed at random irrespective of the array pitch of the phosphor particles 31. The pinhole 33 is formed by separating the metal back 25 and forming a crack or a hole.

That is, in the present embodiment, the ratio of the area of the metal back covering the second region with respect to the area of the peripheral region 24*b* (second region) is smaller than the ratio of the area of the metal back covering the first region with respect to the area of the central region 24*a* (first region) since a great number of pinholes 33 are formed in the peripheral region 24*b* than in the central region 24*a*. Here, the area of the metal back covering the second region and the area of the metal back covering the first region refer to areas of the metal back in a projection area to a surface parallel to the face plate 20 from the plate orthogonal direction D. For instance, when light is projected from the outer side of the face plate 20 (side not formed with rear plate 40), and the transmitted light is measured on the inner side of the face plate 20 (side formed with rear plate 40), the area of the portion where transmitted light is not measured corresponds to the area of the metal back in the present invention.

In the peripheral region 24*b*, when outside light enters, some light passes through the pinhole 33 towards the rear plate 40 side. Thus, the reflection at the metal back 25 is suppressed and diffuse reflectance is reduced at the peripheral region 24*b*, whereby blackness can be improved compared to the prior art.

As described above, the surface withstand voltage property can be improved by separating the metal back, but in this case as well, potential difference is created between the separated metal backs in time of discharge. Thus, unless the surface withstand voltage comparable to the potential difference is ensured, the discharge region extends and the discharge current increases. In the present embodiment, the current flows through the metal back of high resistance state that is separated in time of discharge since the metal back is separated at the peripheral region. This has an advantage that the surface withstand voltage property enhances.

Furthermore, the present embodiment also has an advantage in that vacuum property as the display apparatus is improved. Various resins and solvents such as organic resin solution having acrylate resin as the main component are used in forming the phosphor screen, but such resins and solvents separate and annihilate upon calcination. However, supply of oxygen is essential in separation and annihilation, where separation and annihilation become insufficient if oxygen lacks and resins and solvents remain in the internal space of the display apparatus, thereby causing vacuum deterioration The electron-emitting device is sensitive to residual gas, and in particular, the gas discharge rate of the phosphor screen facing the electron-emitting device must be strictly suppressed. In the prior art, oxygen supply is shielded by the metal back on the inner side covered by the metal back, and thus separation and annihilation of resins and solvents tend to be insufficient. Since the metal back 25 is separated at the peripheral region 24*b* in the present embodiment, the oxygen is supplied to the inner side of the metal back 25 from the pinhole 33 of the metal back 25, thereby rapidly separating and annihilating resins and solvents. The pinhole 33 also promotes discharge of gas generated from separation of resin and solvent, and thus vacuum property can be further improved.

The method of manufacturing the metal back described above is basically the same as the method of manufacturing the metal back of the first embodiment. In the first embodiment, one part of the vertex of the upper most phosphor particles 31 of the filled phosphor particles 31 is exposed when forming the first planarizing layer 28. In the second embodiment, on the other hand, the degree of exposing the vertex of the upper most phosphor particles 31 of the filled phosphor particles 31 is larger than in the first embodiment when forming the first planarizing layer 28. Specifically, for example, when the first planarizing layer 28 is formed to an extent of exposing all of the upper most phosphors, the metal back having pinholes 33 of the present embodiment can be formed.

Third Embodiment

Figure 5:
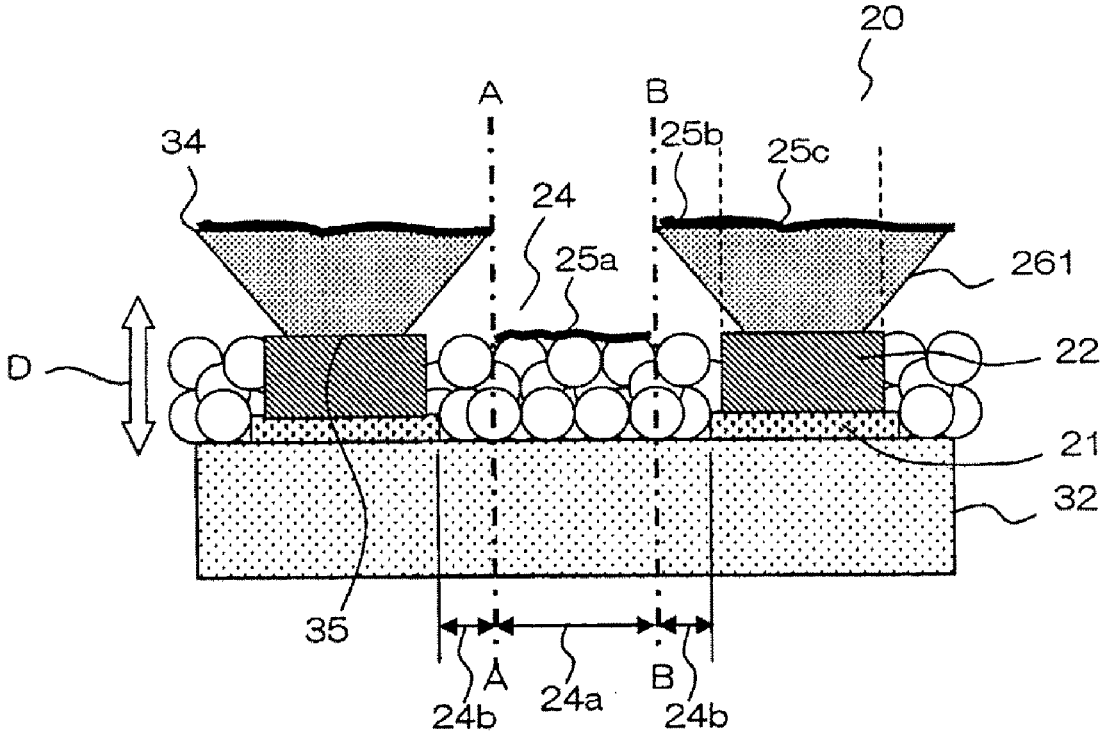
FIG. 5 is a schematic cross sectional view of a face plate showing a third embodiment of the present invention.
Figure 6:
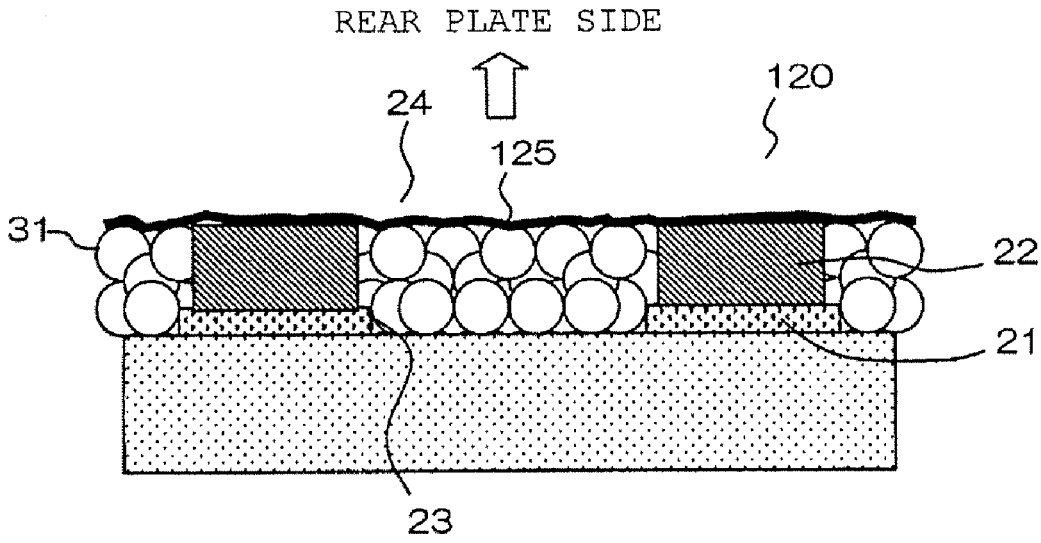
PRIOR ART Fig. 6
FIG. 6 is a view showing a general phosphor screen configuration in a conventional flat display apparatus.

FIG. 5 is a schematic cross sectional view of the face plate showing a third embodiment of the present invention. The present embodiment has feature in that the metal back separation layer is formed greatly projecting out so as to cover the peripheral region, and the metal back is not formed at the peripheral region of the light-emitting body.

The face plate 20 includes the light shielding layer 21 that partitions the adjacent light-emitting bodies 24, and the metal back separation layer 261. The metal back separation layer 261 includes a first edge face 34 extending along the plate orthogonal direction D and close to the electron-emitting device, and a second edge face 35 distant from the electron-emitting device. The first edge face 34 covers the light shielding layer 21 and the peripheral region 24*b* when the face plate 20 is viewed from the rear plate (not shown) in the plate orthogonal direction D, and the second edge face 35 covers at least one part of the light shielding layer 21. The metal back 25 further includes a third portion 25*c* for covering the light shielding layer 21 when the face plate 20 is viewed from the rear plate in the plate orthogonal direction D. The second and third portions 25*b*, 25*c* are arranged covering the metal back separation layer 261 at positions closer to the electron-emitting device than the first portion 25*a*. The metal back separation layer 261 projects out in the lateral direction to the light-emitting body 24 side, and forms a region where the metal back 25 is not deposited in the peripheral region 24*b* of left and right ends of the light-emitting body 24, but the region where the metal back is not deposited is not limited thereto.

In the present embodiment, the metal back (second portion 25*b*) that was closely attached to the peripheral region 24*b* in the first and second embodiments is arranged on the metal back separation layer 261. Thus, it is necessary for the outside light to pass through one part of the metal back separation layer 261 in order to enter the second portion 25*b*, and thus the intensity of the outside light that reaches the second portion 25*b* becomes smaller than when the second portion 25*b* is formed on the phosphors. Thus, the diffuse reflectance lowers and blackness improves compared to the prior art. Furthermore, since the metal back 25 is not arranged on the peripheral region 24*b* in the present embodiment, the same or greater effects as the second embodiment are obtained for surface withstand voltage and vacuum property.

Fourth Embodiment

In the first embodiment and the second embodiment, the effect of the present invention is obtained if the second portion 25*b* of the metal back is arranged on at least one part of the peripheral region 24*b* of the light-emitting body 24. For instance, the second portion 25*b* of the metal back may be arranged on the left and right ends or the upper and lower ends of the light-emitting body 24, or the second portion 25*b* of the metal back may be arranged on one side of the light-emitting body 24.

In the third embodiment, the effect of the present invention is obtained as long as the region where the metal back 25 is not deposited is formed in at least one part of the peripheral region 24*b* of the light-emitting body 24. For instance, the region where the metal back 25 is not deposited maybe formed in the peripheral region 24*b* of the left and right ends or the upper and lower ends of the light-emitting body 24, or the region where the metal back 25 is not deposited may be formed on one side of the light-emitting body 24.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-309175, filed on Nov. 15, 2006 which is hereby incorporated by reference herein in its entirety.

What is claimed is:

1. An image display apparatus comprising a rear plate and a face plate facing the rear plate; wherein said rear plate includes an electron-emitting device;

said face plate includes a light-emitting body which emits light by electron irradiated from said electron-emitting device and a metal back arranged between said electron-emitting device and said light-emitting body, said light-emitting body including a first region in which a luminance with respect to a maximum value of a luminance in the light-emitting body is greater than or equal to 50% and a second region in which a luminance with respect to a maximum value of a luminance in the light-emitting body is less than 50%; and an arithmetic mean deviation of the profile of the metal back in said second region is larger than the arithmetic mean deviation of the profile of the metal back in said first region.

2. An image display apparatus according to claim 1, wherein said face plate includes a plurality of the light-emitting bodies and a light shielding member between said adjacent light-emitting bodies; and the metal back covering said light shielding member is separated from the metal back contacting said light-emitting body.

3. An image display apparatus according to claim 2, wherein said metal back is electrically separated from said adjacent metal back along at least one side of said light-emitting body.

4. An image display apparatus comprising a rear plate and a face plate facing the rear plate; wherein said rear plate includes an electron-emitting device;

said face plate includes a light-emitting body which emits light by electron irradiated from said electron-emitting device, and a metal back arranged between said electron-emitting device and said light-emitting body, said light-emitting body including a first region in which a luminance with respect to a maximum value of a luminance in the light-emitting body is greater than or equal to 50% and a second region in which a luminance with respect to a maximum value of a luminance in the light-emitting body is less than 50%; and a ratio of an area of the metal back covering said second region with respect to an area of said second region is smaller than a ratio of an area of the metal back covering said first region with respect to an area of said first region.

5. An image display apparatus according to claim 4, wherein said face plate includes a plurality of the light-emitting bodies and a light shielding member between said adjacent light-emitting bodies; and the metal back covering said light shielding member is separated from the metal back contacting said light-emitting body.

6. An image display apparatus according to claim 5, wherein said metal back is electrically separated from said adjacent metal back along at least one side of said light-emitting body.

7. An image display apparatus comprising a rear plate and a face plate facing the rear plate; wherein said rear plate includes an electron-emitting device;

said face plate includes a light-emitting body which emits light by electron irradiated from said electron-emitting device, and a metal back arranged between said electron-emitting device and said light-emitting body, said light-emitting body including a first region in which a luminance with respect to a maximum value of a luminance in the light-emitting body is greater than or equal to 50% and a second region in which a luminance with respect to a maximum value of a luminance in the light-emitting body is less than 50%, said metal back covers at least said first region; and a diffuse reflectance in said second region is smaller than a diffuse reflectance in said first region.

8. An image display apparatus according to claim 7, wherein said face plate includes a plurality of the light-emitting bodies and a light shielding member between said adjacent light-emitting bodies; and the metal back covering said light shielding member is separated from the metal back contacting said light-emitting body.

9. An image display apparatus according to claim 8, wherein said metal back is electrically separated from said adjacent metal back along at least one side of said light-emitting body.

* * * * *